US005680894A

United States Patent [19]

Kilbert

[11] Patent Number: 5,680,894

[45] Date of Patent: Oct. 28, 1997

[54] APPARATUS FOR THE INJECTION MOLDING OF A METAL ALLOY: SUB-RING CONCEPT

[75] Inventor: Robert K. Kilbert, Racine, Wis.

[73] Assignee: Lindberg Corporation, Rosemont, Ill.

[21] Appl. No.: 735,526

[22] Filed: Oct. 23, 1996

[51] Int. Cl.[6] ..... B22D 17/00; B22D 13/00

[52] U.S. Cl. ..... 164/312; 164/113; 164/900

[58] Field of Search ..... 164/312, 113, 164/900

[56] References Cited

U.S. PATENT DOCUMENTS

| | | |
|---|---|---|
| 2,505,540 | 4/1950 | Goldhard . |
| 3,189,945 | 6/1965 | Strauss . |
| 3,762,848 | 10/1973 | Muller . |
| 3,902,544 | 9/1975 | Flemings et al. . |
| 4,060,362 | 11/1977 | Wilson, III . |
| 4,135,873 | 1/1979 | Sone et al. . |
| 4,251,202 | 2/1981 | Asari et al. . |
| 4,311,185 | 1/1982 | Zimmerman . |
| 4,501,550 | 2/1985 | Nikkuni . |
| 4,714,423 | 12/1987 | Hattori et al. . |
| 4,730,658 | 3/1988 | Nakano . |
| 4,749,021 | 6/1988 | Nakano . |
| 4,816,197 | 3/1989 | Nunn . |
| 5,040,589 | 8/1991 | Bradley et al. . |
| 5,501,266 | 3/1996 | Wang et al. . |

FOREIGN PATENT DOCUMENTS

| | | |
|---|---|---|
| 525229-A1 | 2/1993 | European Pat. Off. . |
| 62-114757 | 5/1987 | Japan . |
| 1-254364 | 10/1989 | Japan . |
| 5-131254 | 5/1993 | Japan . |
| 1303259-A1 | 4/1987 | U.S.S.R. . |
| 1726117 | 4/1992 | U.S.S.R. ..... 164/312 |

*Primary Examiner*—Joseph J. Hail, III
*Assistant Examiner*—I. H. Lin
*Attorney, Agent, or Firm*—Bell, Boyd & Lloyd

[57] ABSTRACT

The present invention reveals an improvement in an apparatus for injection molding a metallic material having dendritic properties. In the improvement, a sub-ring is placed under a piston ring on a sliding seal ring of a non-return valve assembly. The sub-ring seals the pressure and metal flow in the apparatus, virtually eliminates piston ring leakage and extends the usable life of the non-return valve assembly.

8 Claims, 5 Drawing Sheets

Fig. 5A
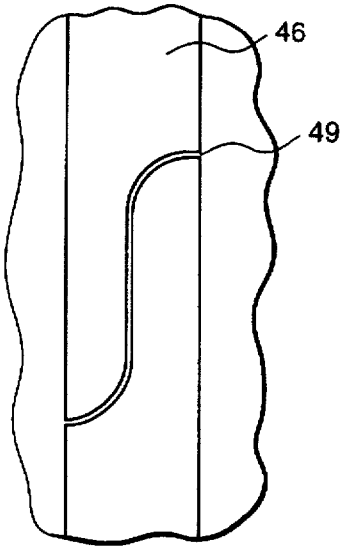
Fig. 5B
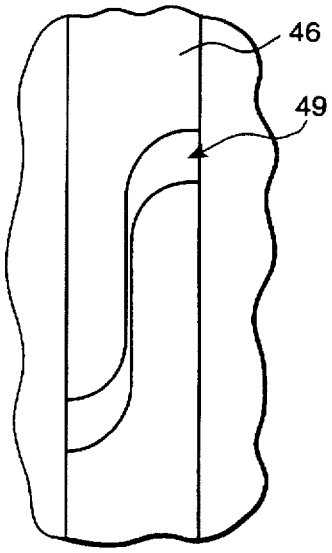
Fig. 6A
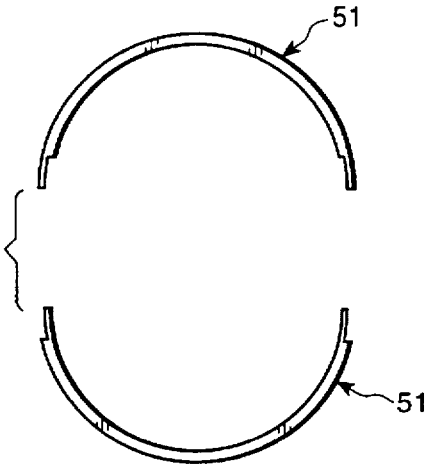
Fig. 6B
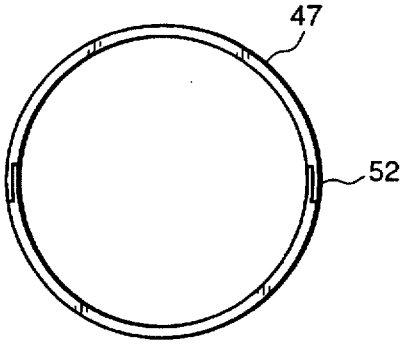
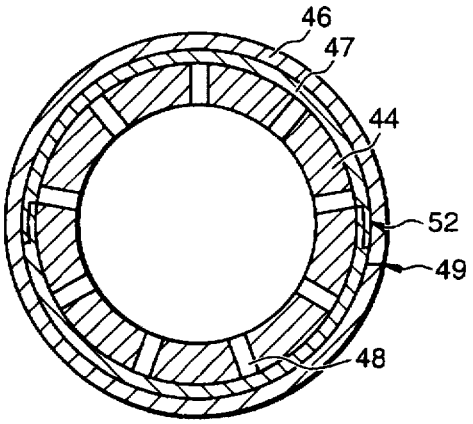
Fig. 7

APPARATUS FOR THE INJECTION MOLDING OF A METAL ALLOY: SUB-RING CONCEPT

BACKGROUND OF THE INVENTION

1. Field of the Invention

The present invention is for an improvement of an apparatus for the injection molding of a metal alloy. In the improvement, a sub-ring is placed under a piston ring on a sliding seal ring of a non-return valve assembly. The sub-ring seals the pressure and metal flow in the apparatus, virtually eliminates piston ring leakage and extends the usable life of the non-return valve assembly.

2. Description of the Related Art

Metal alloys having dendritic crystal structure at ambient temperature conventionally have been melted and then subjected to high pressure die casting procedures. Such conventional die casting procedures have certain problems associated therewith such as melt loss, contamination with flux or the like, excessive scrap, rather high energy consumption, somewhat lengthy duty cycles, limited die life due to high thermal shock or the like, and restricted die filling positions. The alloys involved include, but are not limited to, alloys described in U.S. Pat. Nos. 3,840,365; 3,842,895; 3,902,544; and 3,936,298.

Plastics injection molding techniques have many features which would be advantageous if they could be included in the injection molding of such metal alloys which can be converted into a thixotropic state. Such techniques include the feeding of plastic granules at room temperature from a hopper into a screw extruder in the absence of flux and other impurities. The plastic material is heated in the extruder to become plasticized, following which a mold positioned at the discharge end of the extruder is filled with the flowable material. There are no contamination and melt losses associated with plastic extrusion procedures, and the lower temperatures utilized in such procedures reduce the problem of thermal shock to the mold. In injection molding of plastics, the mold can be filled from any position as dictated by maximum efficiency for part fillings.

U.S. Pat. Nos. 4,694,881 and 4,694,882 disclose the conversion of a metal alloy having dendritic properties into a thixotropic, semi-solid state by controlled heating so as to maintain the alloy at a temperature above its solids temperature and below its liquidus temperature while subjecting the alloy to a shearing action during injection molding. In this manner, certain advantages of injection molding can be utilized to overcome certain disadvantages of die casting.

U.S. Pat. No. 5,040,589, the entire contents of which are hereby incorporated by reference and relied upon, discloses a method and apparatus for substantially improving the injection molding of thixotropic metal alloys. The method and apparatus improve the injection molding process by establishing and maintaining a temperature profile for a given alloy by heating the alloy in a screw extruder to a temperature above its solidus temperature and below its liquidus temperature and, prior to the injection stroke, avoiding the imposition of any appreciable increase of force on the alloy. This is accomplished by delivering the semi-solid material to an accumulation space or zone between the extruder nozzle and the extruder screw tip and withdrawing or retracting the screw, while it rotates, in a direction away from the discharge nozzle as the space between the nozzle and the tip of the screw is filled with material. In conventional plastics molding, the retraction of the extruder screw is accomplished by pressure buildup in the space between the nozzle and the extruder screw tip.

Because of the nature of metal alloys, it has been found necessary to control carefully the stages of pressurization of such alloys in their semi-solid state in the extruder. A desired shearing rate must be maintained, thus dictating the speed of rotation of the screw and the rate at which material is fed to the extruder. This further dictates the speed of retraction of the screw prior to the injection stroke. Still further, when injection molding a semi-solid metallic material, it is important to control temperature, pressure, and extruder screw speed conditions to prevent phase separation of the combined liquid-solid states of the alloy. In controlling the temperature profile, feeding rate, shearing speed, injection pressure, and injection velocity to the extent to be described hereinafter, plastics injection molding procedures and machines advantageously may be adapted for use in the forming of die cast parts from metal alloys.

Injection molding of a metal alloy is a unique process for the production of high quality molded parts. The process differs from high pressure die casting in that it starts with room temperature pellets, powder or chips and feeds them under inert atmospheric conditions thus eliminating the traditional melting pot and its inherent problems. It also differs from the recently developed injection molding process that uses a plastic or wax binder as a flow aid. Since no binder is used, the molded metal article is the finished product and requires no debinding process. The technology involved in the process for the injection molding of a metal alloy is based on the formation of a semi-solid thixotropic slush which enables the metal to be injection molded.

Properties of the molded parts produced according to the process for the injection molding of a metal alloy compare favorably with high pressure die cast parts. In certain respects, parts made in accordance with the process for the injection molding of a metal alloy show improved properties. For example, injection molded parts produced in accordance with the process consistently exhibit lower porosity than similar die cast counterparts. Porosity significantly reduces the allowable design strength of a part.

U.S. Pat. No. 5,040,589 further discloses an apparatus for the injection molding of a metal alloy. The apparatus is essentially a conventional form of a thermoplastic injection molding machine incorporating certain modifications to enable semi-solid metallic material to be molded according to the process for the injection molding of a metal alloy.

More specifically, the apparatus for injection molding a metal alloy having dendritic properties comprises:

(a) an extruder barrel having a discharge nozzle at one end, a material accumulation zone adjacent the nozzle, and an inlet remote from the nozzle;

(b) feeding means for introducing the material into the barrel via the inlet;

(c) means for heating material in the barrel to a temperature which is sufficiently high to inhibit dendritic growth;

(d) means for moving the material through the barrel from the inlet into the accumulation zone;

(e) means for expanding the accumulation zone independently of the movement of the material into the accumulation zone and at a rate at least as great as that at which the material is moved into the accumulation zone, thereby avoiding the imposition of appreciable force on the material in the accumulation zone;

(f) means for shearing the material as it moves through the barrel between the inlet and the accumulation zone; and (g) means for discharging the material from the accumulation zone through the nozzle into a mold.

In the apparatus for injection molding a metal alloy, a screw, i.e., the means for moving material through said barrel, inside of the barrel melts and conveys the alloy forward past a non-return valve assembly, into the accumulation zone. A seal on a sliding ring is critical because the screw is moved forward (at very high speed and pressures) forcing the semi-molten alloy into the mold forming the desired component. A good seal produces sound, low-porosity components which is a main advantage of the process. The viscosity of the semi-molten alloy is near to that of water and the pressures used during injection can reach 20,000 psi.

It has been very difficult to maintain a good seal for very long without piston rings on the sliding ring. The addition of piston rings has increased the productive life of the non-return valve assembly. However, there is still leakage through the overlap created by the piston ring ears. This leakage is minimal when the piston rings are new but as the rings wear the gap increases causing increasing leakage which ultimately leads to seal failure.

The present invention is for an improvement over the apparatus for the injection molding of a metal alloy disclosed in U.S. Pat. No. 5,040,589. A sub-ring is a ring that fits under the piston ring and seals the pressure and metal flow (through the pressure equalizing holes) from exiting through the piston ring gap even as the piston ring wears and the gap becomes larger. The sub-ring concept of the present invention virtually eliminates the piston ring leakage and extends the usable life of the non-return valve assembly.

A review of the applicable art has failed to uncover an apparatus for the injection molding of a metal alloy fitted with a sub-ring that eliminates piston ring leakage. For example, the abstract of European Patent Application 0 525 229 (Muller) discloses a piston for extruding liquid metal in a pressure die casting machine. The abstract does not disclose a non-return valve assembly having a piston ring with a sub-ring.

U.S. Pat. No. 5,501,266 (Wang et al.) discloses an apparatus for injection molding of semi-solid materials. The apparatus has a non-return valve but does not include a piston ring with a sub-ring.

The abstract of Japanese Patent Application 5-131254 (Nakamura) discloses an apparatus for the injection molding of molten metals. The abstract indicates that the purpose of the apparatus is to prevent the intrusion of molten metal between the tip and the inside surface of an injection sleeve. The patent application does not appear to disclose a non-return valve having a piston ring with a sub-ring.

U.S. Pat. No. 4,311,185 (Zimmerman) discloses an injection piston for a die casting machine. The injection piston includes a ring 38 (see column 4, line 16; and FIG. 2). However, the patent does not disclose a sub-ring.

U.S. Pat. No. 4,135,873 (Sone et al.) discloses an apparatus for injection molding of plastic materials. The apparatus appears to have a non-return valve but does not include a piston ring with a sub-ring.

U.S. Pat. No. 4,816,197 (Nunn) discloses an apparatus for injection molding of plastic. The apparatus does not include a non-return valve having a piston ring with a sub-ring.

U.S. Pat. No. 4,060,362 (Wilson) discloses an apparatus for injection molding of plastic materials. The apparatus does not include a non-return valve having a piston ring with a sub-ring.

U.S. Pat. No. 3,902,544 (Flemings et al.) discloses a screw extrusion apparatus for forming a homogeneous mixture of a liquid-solid metal composition. The patent does not disclose a non-return valve having a piston ring with a sub-ring.

U.S. Pat. No. 2,505,540 (Goldhard) discloses an injection molding apparatus for plastic materials. The patent does not disclose a non-return valve having a piston ring with a sub-ring.

U.S. Pat. No. 5,040,589 (Bradley et al.) provides the basis for the improvement of the present invention. The patent discloses an injection molding apparatus for molding a metal alloy. The apparatus does not include a non-return valve having a piston ring with a sub-ring.

U.S. Pat. No. 3,189,945 (Strauss) discloses an injection molding apparatus for thermoplastic materials. The apparatus does not include a non-return valve having a piston ring with a sub-ring. Additionally, this patent was considered in the prosecution of U.S. Pat. No. 5,040,589 (Bradley et al.).

U.S. Pat. No. 3,762,848 (Muller) discloses an injection molding apparatus for plastics. The apparatus includes an injection piston 21 which may have piston rings associated with it (see FIG. 1 of the Muller patent). However, the patent does not disclose a sub-ring.

U.S. Pat. No. 4,501,550 (Nikkuni) discloses an injection molding apparatus for resin materials. The apparatus does not include a non-return valve having a piston ring with a sub-ring.

U.S. Pat. No. 4,251,202 (Asari et al.) discloses a die stem for an extrusion press. The patent does not disclose a non-return valve having a piston ring with a sub-ring.

U.S. Pat. No. 4,730,658 (Nakano) discloses a die casting machine. The patent does not disclose a non-return valve having a piston ring with a sub-ring.

U.S. Pat. No. 4,749,021 (Nakano) discloses a die casting machine. The patent does not disclose a non-return valve having a piston ring with a sub-ring.

U.S. Pat. No. 4,714,423 (Hattori et al.) discloses an evacuating device for a plunger molding apparatus. The patent discloses an O-ring 27 (see column 3, line 35; and FIG. 4). However, the patent does not disclose a non-return valve having a piston ring with a sub-ring.

The abstract of Soviet Patent Application 1303259 discloses a pressure die caster with a piston ejector. However, the abstract does not disclose a non-return valve assembly having a piston ring with a sub-ring.

The abstract of Japanese Patent Application 1-254364 (Nakamura) discloses a semi-melting metal injection molding device. The abstract does not appear to disclose a non-return valve having a piston ring with a sub-ring.

The abstract of Japanese Patent Application 62-114757 (Fukui) discloses an injection sleeve for die casting. The abstract does not appear to disclose a non-return valve having a piston ring with a sub-ring.

Thus, nothing in the prior art suggests an apparatus for the injection molding of a metal alloy fitted with a sub-ring that eliminates piston ring leakage.

SUMMARY OF THE INVENTION

The present invention is for an improvement in an apparatus for injection molding a metallic material having dendritic properties. The apparatus comprises:

(a) an extruder barrel having a discharge nozzle at one end, a material accumulation zone adjacent the nozzle, and an inlet remote from the nozzle;

(b) feeding means for introducing the material into the barrel via the inlet;

(c) means for heating material in the barrel to a temperature which is sufficiently high to inhibit dendritic growth;

(d) means for moving the material through the barrel from the inlet into the accumulation zone, wherein the means for moving the material through the barrel comprises an extruder screw having a non-return valve assembly and wherein the non-return valve assembly comprises a sliding seal ring and one or more piston rings, the piston rings situated between the sliding seal ring and the extruder barrel;

(e) means for expanding the accumulation zone independently of the movement of the material into the accumulation zone and at a rate at least as great as that at which the material is moved into the accumulation zone, thereby avoiding the imposition of appreciable force on the material in the accumulation zone;

(f) means for shearing the material as it moves through the barrel between the inlet and the accumulation zone; and (g) means for discharging material from the accumulation zone through the nozzle into a mold.

The improvement comprises the non-return valve assembly having a sub-ring, the sub-ring situated between one or more piston rings and the sliding seal ring.

In addition, the barrel of the apparatus has a plurality of longitudinally spaced heating zones, each of which is heated by the heating means to establish for the material a temperature profile which increases in a direction toward the nozzle. The heating means maintains the temperature of the material in the barrel between the liquidus and the solidus temperatures of the material and maintains the temperature of the material in the accumulation zone at a level higher than elsewhere.

The feeding means includes means for introducing the material into the barrel at a rate up to 100 percent of its capacity. The material introduced via the feeder into the barrel is in pellet form and is introduced into the barrel at ambient temperature. The means for expanding the accumulation zone comprises means for moving the screw in a direction away from the nozzle.

BRIEF DESCRIPTION OF THE DRAWINGS

FIGS. 5A and 5B are enlarged partial views of a piston ring. FIG. 5A is a view of a new piston ring showing a tight gap. FIG. 5B is a view of a worn piston ring showing an enlarged gap.

FIGS. 6A and 6B show a sub-ring. FIG. 6A shows the two semi-circular sub-ring segments. FIG. 6B shows the assembled sub-ring.

FIG. 7 shows a cross section of the sliding ring, piston ring, sub-ring assembly.

DETAILED DESCRIPTION OF THE INVENTION

Figure 1:
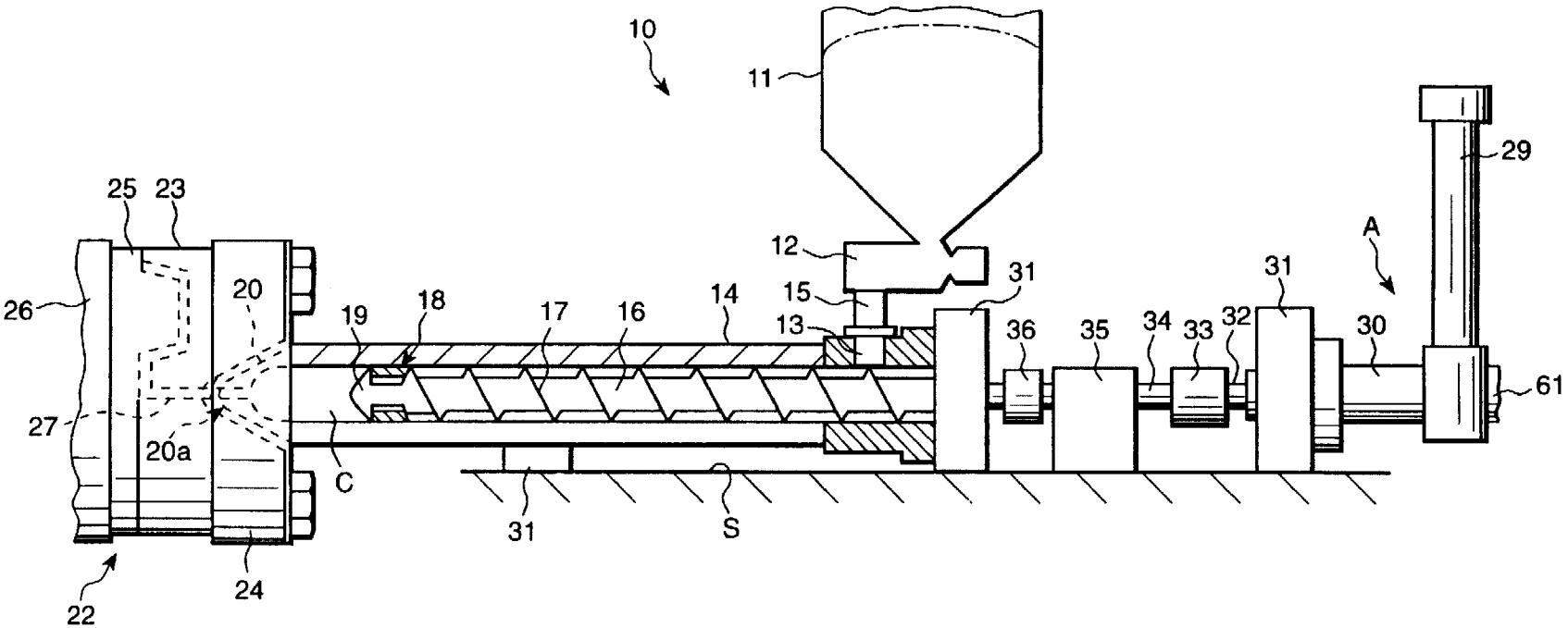
FIG. 1 is a schematic side view, partly in section, of an apparatus for injection molding a metallic material.

The present invention can be better understood with reference to the accompanying drawings wherein FIG. 1 schematically illustrates an apparatus 10 for injection molding a metallic material having dendritic properties. The apparatus 10 includes a feed hopper 11 for the accommodation of a supply of pellets, chips, or powder of a suitable metal alloy, e.g., magnesium, aluminum, or zinc, at room temperature. For purposes of describing the salient features of the present invention, magnesium alloys will be referred to as examples of suitable metal alloys that may be used in practicing the invention.

A suitable form of feeder 12, such as an Acrison 105E volumetric feeder, is in communication with the bottom of the hopper 11 to receive pellets therefrom by gravity. The feeder includes an auger (not shown) which functions to advance pellets at a uniform rate to the extruder. The feeder 12 is in communication with a feed throat 13 of an extruder barrel 14 through a vertical conduit 15 which delivers a quantity of pellets into the extruder barrel 14 at a rate determined by the speed of the feeder auger. An atmosphere of inert gas is maintained in the conduit 15 and extruder barrel 14 during feeding of the pellets so as to prevent oxidation thereof. A suitable inert gas is argon and its supply is effected in a conventional manner.

Extruder barrel 14 accommodates a reciprocable and rotatable extruder screw 16 provided with a helical flight or vane 17. Adjacent the discharge end of the barrel, the screw has a non-return valve assembly be 18 and terminates in a screw tip 19. The discharge end of barrel 14 is provided with a nozzle 20 having a tip 20*a* received and aligned by a sprue bushing (not shown) mounted in a suitable two-part mold 22 having a stationary half 23 fixed to a stationary platen 24. The mold half 23 cooperates with a movable mold half 25 carried by a movable platen 26. The mold halves define a suitable cavity 27 in communication with the nozzle. Mold 22 may be of any suitable design. Although not shown in the drawings, suitable and conventional mold heating and/or chilling means may be supplied if required.

The opposite end of the injection molding apparatus 10 includes a known form of high speed injection apparatus A including an accumulator 29 and a cylinder 30 supported by stationary supports 31 on a suitable support surface S. Downstream from the cylinder 30, a shot or injection ram 32 projects into a thrust bearing and coupler 33 for operational connection in known manner with a drive shaft 34 for the rotary and reciprocable extruder screw 16. Thrust bearing and coupler 33 separate shot ram 32 from drive shaft 34 so that shot ram 32 may merely reciprocate and not rotate when desired.

Drive shaft 34 extends through a conventional form of rotary drive mechanism 35 which is splined to drive shaft 34 to permit horizontal reciprocation of drive shaft 34 in response to reciprocation of shot ram 32 while the drive shaft 34 rotates. This shaft is in turn coupled with extruder screw 16 through a drive coupling 36 of known type to transmit rotation to extruder screw 16 as well as high speed axial movement within barrel 14 in response to operation of high speed injection apparatus A. It will be understood that suitable and conventional hydraulic control circuits will be used in the conventional manner to control the operation of injection molding apparatus 10.

Typically, operation of the injection molding apparatus 10 invives rotation of extruder 16 within barrel 14 to advance and continuously shear the feed stock supplied through feed throat 13 to a material accumulation chamber or zone C between the screw tip 19 and the nozzle. Suitable heating means of a type to be described supply heat to barrel 14 to establish a temperature profile which results in conversion of the feed stock to a slushy or semi-solid state at a temperature which is above its solidus temperature and below its liquidus temperature. In the semi-solid state, the material is subjected to shearing action by the extruder screw 16 and such material is continuously advanced toward the discharge end of the barrel to pass the non-return valve be in sufficient accumulated volume ultimately to permit high speed forward movement of extruder screw 16 to accomplish a mold filling injection or shot.

High speed injection apparatus A functions at the appropriate time to move shot ram 32 forwardly, or toward the discharge end of the extruder, which results in forward movement of the thrust bearing 33 and drive shaft 34. Since drive shaft 34 is coupled to the shaft of extruder screw 16 through coupling 36, extruder screw 16 moves forward quickly to accomplish the mold filling shot. Non-return valve assembly 18 prevents the return of backward movement of the semi-solid metal accumulated in the chamber C during the mold filling shot.

An important objective of the apparatus is to reach a maximum injection velocity in a short time during the first part of the shot cycle, maintain such velocity for a sufficient time to establish the requisite shot size and then rapidly reduce the velocity to zero just as the mold cavity is filled to avoid impact and rebound of the extruder screw 16.

There are two principal methods of feeding the screw extruder. One method is starve feeding and involves delivering the material to the barrel at such rate that the material in the barrel is less than the barrel's full capacity. Accordingly, output of the extruder is controlled by feeder 12. The second method is flood feeding and is achieved by simply filling feed throat 13 with pellets and allowing the screw to convey the material away at the maximum possible rate. In this case, the extruder output is dependent upon the design of the screw 16 and its speed of rotation.

It was originally thought that starve feeding of metallic material was the preferable method of feeding the screw extruder. However, with improvements in screw design and heater band watt density, both starve and flood feed methods are now conventionally used with the apparatus. Furthermore, it is possible to control the shearing transmitted to the slurry by means of the speed of rotation of the screw 16, and independently of the throughput. Screw rotation may be in the range of 125–175 rpm, but can vary to accommodate specific molding conditions.

From the foregoing it will be clear that the screw 16 not only assists in advancing the semi-solid material along the barrel 14 of the extruder into the accumulation chamber C, but also effects shearing of the material in the extruder to prevent undesirable dendritic growth and liquid-solid phase separation during the injection cycle. Rotation of the screw 16 is maintained at a speed to establish a shear rate of between about 5 and 500 reciprocal seconds.

The extruder screw 16 may be constructed from a suitable material such as hot work tool steel having a suitable, hard facing material on the flights 17 and the inner surface of the barrel 14. A typical tolerance between the outer diameter of the screw and the inner surface of the barrel 14 at normal operating temperatures is 0.015 inch. The flights of the screw extend beyond feed throat 13 toward support member 31 to prevent the packing of magnesium fines in the hub of the screw shaft which can stall rotation of the screw.

Barrel 14 is preferably bimetallic having an outer shell of alloy I-718, which is a high nickel alloy and provides strength and fatigue resistance to operating temperatures in excess of 600° C. Since the alloy I-718 will corrode rapidly in the presence of magnesium at temperature under consideration, a liner of high cobalt material, such as Stellite 12 (Stoody-Doloro-Stellite Corporation) is shrunk fit or hipped (hot isostatic pressed) onto the inner surface of the barrel 14. Any appropriate bimetallic barrel having chemical and thermal resistance, sufficient strength to withstand shot pressure, and resistance to wear may be used.

A typical magnesium alloy that can be used in practicing the invention is AZ91B, containing 90% Mg, 9% Al, and 1% Zn. This alloy has a solidus temperature of 465° C., a liquidus temperature of 596° C., and a desirable slush morphology temperature of approximately 580°–590° C., preferably 585° C.

Figure 2:
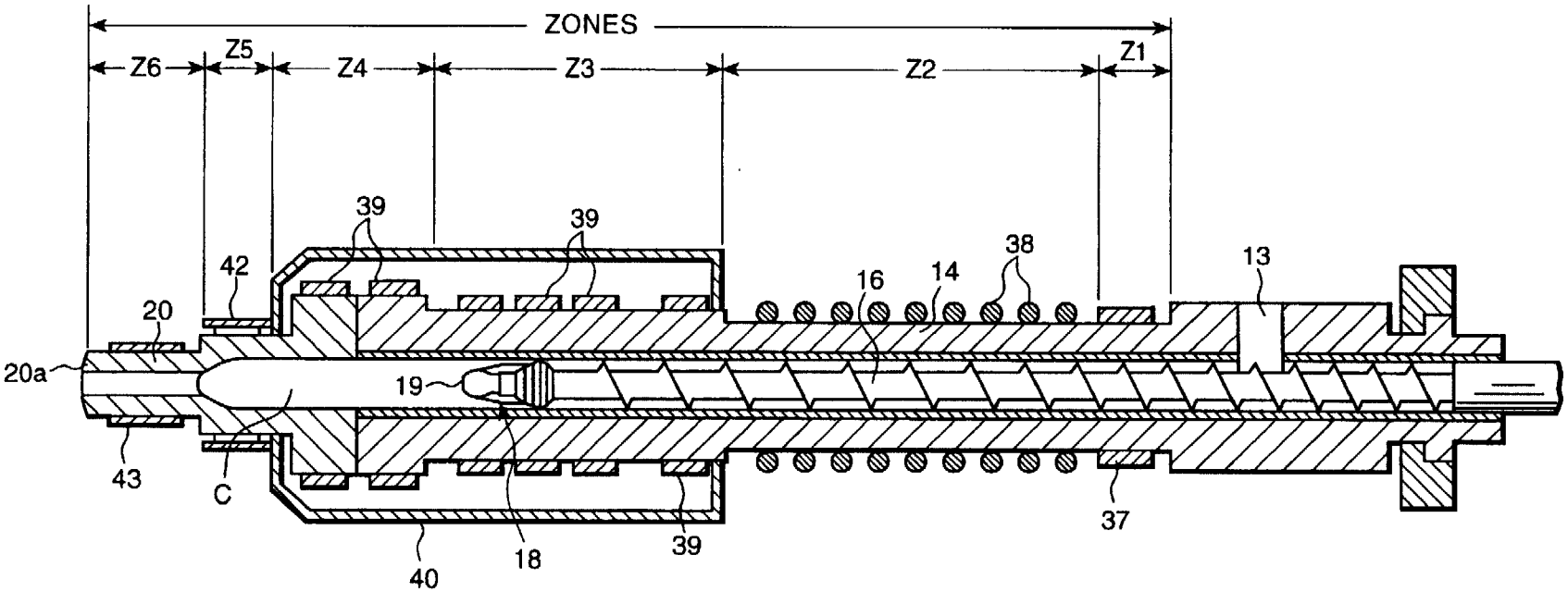
FIG. 2 is a schematic illustration of an extruder barrel and screw, including the application of heating means to establish heating zones.

FIG. 2 illustrates a heating apparatus for the extruder which encircles the outer surface of barrel 14 and is preferably divided into heating zones Z1–Z6. In general, the magnesium alloy pellets are heated by conduction through the extruder barrel. In the original apparatus, the barrel was heated partially by induction and partially by ceramic band resistance heaters. Advances in ceramic resistance band heaters now allow the entire barrel to be heated by ceramic bands alone. The use of ceramic resistance band heaters alone results in better temperature control and a less costly machine design.

FIG. 2 is an illustration of the original apparatus and shows the use of a band resistance heater 37 in heating zone Z1 just shortly downstream of the feed throat 13. By way of example, this heater may be capable of supplying 1100 w. Heating zone Z2 utilizes an induction heater coil 38 which may be part of a Lepel S 50/10 heater. Heating zone Z2 extends for a substantial length along barrel 14 and thus induction heater coil 38 is relied upon to heat the metal alloy up to its slush temperature at a relatively fast rate. The power required for induction heating in zone Z2 may be about 25 kw.

In a direction toward nozzle 20, heating zone Z3 utilizes a series of band resistance heaters 39 which may supply 4.7 kw by way of example. Heating zone Z4 utilizes band resistance heaters 39 which may supply up to 3.2 kw. Heating zones Z3 and Z4 are enclosed in a shroud 40 provided with appropriate controlled air cooling means. These parts may be formed from stainless steel and supplied with an interior layer of 0.5 inch insulation if desired. The temperature of the slush reaches its maximum, or at least very close thereto, in the material accumulation chamber or zone C between the nozzle and the screw tip 19. The accumulation chamber is partly within heating zone Z3 and partly within heating zone Z4.

Heating zone Z5 utilizes a band resistance heater 42 capable of supplying up to 0.75 kw to maintain a first, relatively high temperature in the upstream portion of the nozzle 20. Heating zone Z6 utilizes a band or coiled resistance heater 43 capable of supplying up to 0.6 kw and maintains a second, relatively lower temperature in the remainder of nozzle 20 and particularly in the nozzle tip 20*a*.

FIG. 2 further illustrates that the feed material is delivered into the barrel 14 adjacent its rear or upstream end. At this end of the barrel only limited heating occurs, but granules of material are introduced by the screw 16 and moved forwardly, or downstream into heating zone Z1 and subjected to preliminary heating by the heater 37. The material then is advanced further downstream and subjected to the more pronounced and drastic heating of induction coil 38 at heating zone Z2.

Throughout heating zone Z2 the magnesium alloy material is maintained in a semi-solid state while being continuously conveyed downstream of the barrel 14 and successively through the heating zones Z3–Z5. In the zone Z3, the magnesium alloy material is thixotropic having degenerate, dendritic, spherical grains and is moved by screw 16 past non-return valve assembly 18 into the shot or material accumulation zone C wherein its temperature is maintained by heaters 39 in heating zone Z4, and preferably slightly increased to prevent dendritic crystalline growth due to the discontinuance of the shearing action. As material is delivered into the accumulation zone C, the volume of such zone continuously is increased by retraction of the screw 16 and at a rate corresponding substantially to the rate of filling of the accumulation zone, thereby avoiding an increase in the pressure in the accumulation zone.

At this point in the overall operation, it is important to time the peaking of the temperature profile with the introduction of metallic slush into accumulation zone C just prior to making the injection shot. A sufficiently high temperature is maintained in heating zone Z4 to retain slush morphology and to prevent alloy solidification which would require much higher than liquidus temperatures to melt and clear. The temperature in heating zone Z4 should be sufficient to prevent the presence of more than about 60% solids in the slush but the temperature in heating zone Z3 should not be sufficiently high to prevent the screw from efficient pumping of the slush. For example, pumping of slush by screw action is highly inefficient at 5% or less solids. Different alloys may require substantially different temperature profiles depending upon alloy content. The determining factor in selecting temperatures is the percentage of solids desired during the final injection molding shot. Mold gating design also may have an effect on selection of temperatures.

Figure 3:
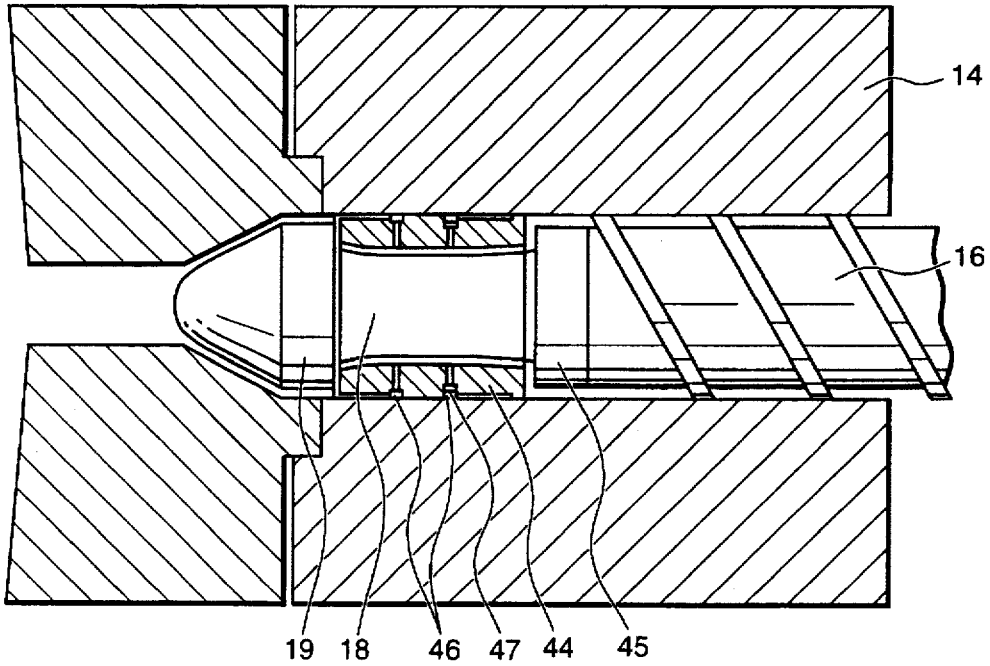
FIG. 3 is an enlargement of the cross-section of the non-return valve assembly of FIGS. 1 and 2.

The non-return valve assembly 18 is best illustrated in FIG. 3. The extruder screw 16 terminates with the non-return valve assembly 18. The function of the non-return valve assembly 18 is to seal and stop back flow of material into the extruder screw 16. The pressure ahead of the tip 19 can reach 20,000 psi (normal operating pressure is about 10,000 psi) with the pressure behind check ring 45 at atmospheric pressure. The quality of the components produced by the apparatus is directly related to how well the non-return valve seal is maintained. We have seen a 30% increase in the life of the seal with the introduction of the sub-ring 47.

The life of the seal is determined by the by-pass rate of material passing the seal into the low pressure zone of the extruder screw 16. A new seal assembly will have a by-pass rate of 0–1 inch per second while a worn seal assembly will have a by-pass rate of 12–15 inches per second. When the by-pass rate reaches 12–15 inches per second, the seal must be replaced.

The non-return valve (seal assembly) 18 is made up of a check ring 45, a sliding seal ring 44, piston rings 46, a sub-ring 47 and a tip 19. The extruder screw 16 and non-return valve assembly 18 in FIG. 3 are shown in the full forward position. From this position, the extruder screw 16 and the non-return valve assembly 18 are retracted to a position determined by the size of the component to be produced. While the extruder screw is retracting, it also rotates causing semi-molten magnesium alloy to flow forward filling the accumulation zone C created in front of the retracting tip 19.

After the extruder screw has reached a predetermined retract position, it is moved rapidly forward displacing the semi-molten mass of magnesium in the accumulation zone C into the mold cavity 27 forming the component. As the extruder screw moves forward, the check ring 45 seals against the sliding seal ring 44 forming the seal that forces the semi-molten mass forward. The piston rings 46 also form a part of the seal during the forward movement of the sliding seal ring 44 preventing high pressure alloy from passing between the outer diameter of the sliding seal ring 44 and the inner diameter of the barrel 14. Pressure equalizing holes 48 (FIG. 4) allow high pressure, semi-solid alloy to pass through the sliding seal ring 44 and cause a pressure build up under the piston rings 46 forcing them out against the barrel walls again sealing the high pressure zone from the extruder screw (low pressure) zone and reducing by-pass (leakage). The integrity of the piston rings/barrel wall and the sliding ring/check ring seals together determine the amount of by-pass (leakage) that occurs into the low pressure zone and have a direct impact on the quality (e.g., lack of porosity) of the components being molded.

The problem with the conventional design lies in the fact that as the piston rings 46 wear on the outer diameter, a gap 49 (shown in FIGS. 5A and 5B) widens allowing the pressure on the underside of the piston rings (caused by molten alloy material coming through the pressure equalizing holes) to more easily by-pass into the low pressure zone. The more the outer diameter of a piston ring wears, the larger the gap becomes and the higher the by-pass rate. The addition of a sub-ring 47 solves this by-pass problem.

Figure 4:
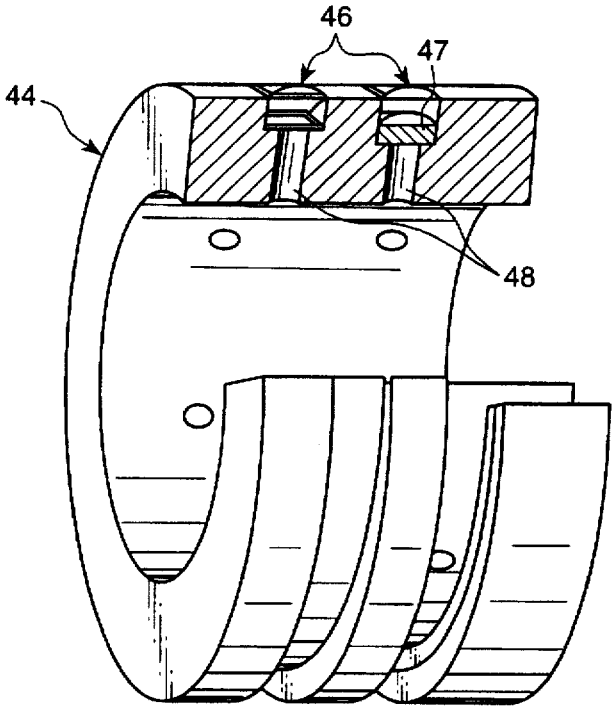
FIG. 4 is an isometric view of the sliding ring of FIG. 3.

The sub-ring 47 is installed directly under the last piston ring 46 on the sliding seal ring 44 (see FIGS. 3 and 4). The sub-ring 47 is a two-piece semi-circular assembly (FIGS. 6A and 6B). The overlapping gaps 52 in the sub-ring are in the opposite direction of the piston ring gaps 49 (FIG. 7). As the pressure comes through the pressure equalization holes 48, it now presses against the sub-ring 47 which in turn forces the piston rings 46 out against the barrel walls.

The orientation of the gaps in the sub-ring prevent the high pressure semi-molten alloy from flowing out through the piston ring gaps even as the piston ring gaps increase with wear. The addition of the sub-ring has lengthened the usable life of the non-return valve seal by 30% over that of the non-return valve and piston ring without the sub-ring. The process of replacing a worn non-return valve assembly takes about 24 hours if done on a three shift basis. During this time, the apparatus is out of production. By adding 30% to the life of the non-return valve seal, the frequency of this change over is significantly reduced and the quality of the components produced over the length of the non-return valve life is improved.

EXAMPLE

The term "by-pass rate", as applied to an apparatus for injection molding of a metallic material, refers to the linear speed that the extruder screw maintains after the die or mold cavity is completely full. This speed is measured in inches per second. The higher the by-pass rate, the faster the material in the accumulation (high pressure) zone is leaking into the low pressure zone behind the non-return valve. A by-pass rate of zero (0) inches per second means that the non-return valve has a perfect seal and no high pressure material is leaking backwards into the low pressure zone. This condition, of course, is the most desirable. However, wear creates leak paths and gradually increases the by-pass rate.

A by-pass rate of 15 inches per second has been found to be the maximum rate acceptable for the consistent operation of the apparatus for the injection molding of a metal alloy. In excess of this, the rate at which material is flowing backward into the low pressure zone causes molten material to flow into zones that are normally occupied by non-molten material, thereby causing plugging of the 15 screw flights and difficulty in forwarding material as the screw rotates. At this point, the non-return valve must be replaced. The apparatus must be taken out of service for at least a 24-hour period for replacement of the non-return valve.

In this Example, the apparatus was used for the injection molding of a magnesium alloy into molded parts. First, the by-pass rate was measured as a function of the number of cycles of continuous operation using an apparatus without a sub-ring. Next, the by-pass rate was measured as a function of the number of cycles of continuous operation using an apparatus equipped with a sub-ring.

Figure 8:
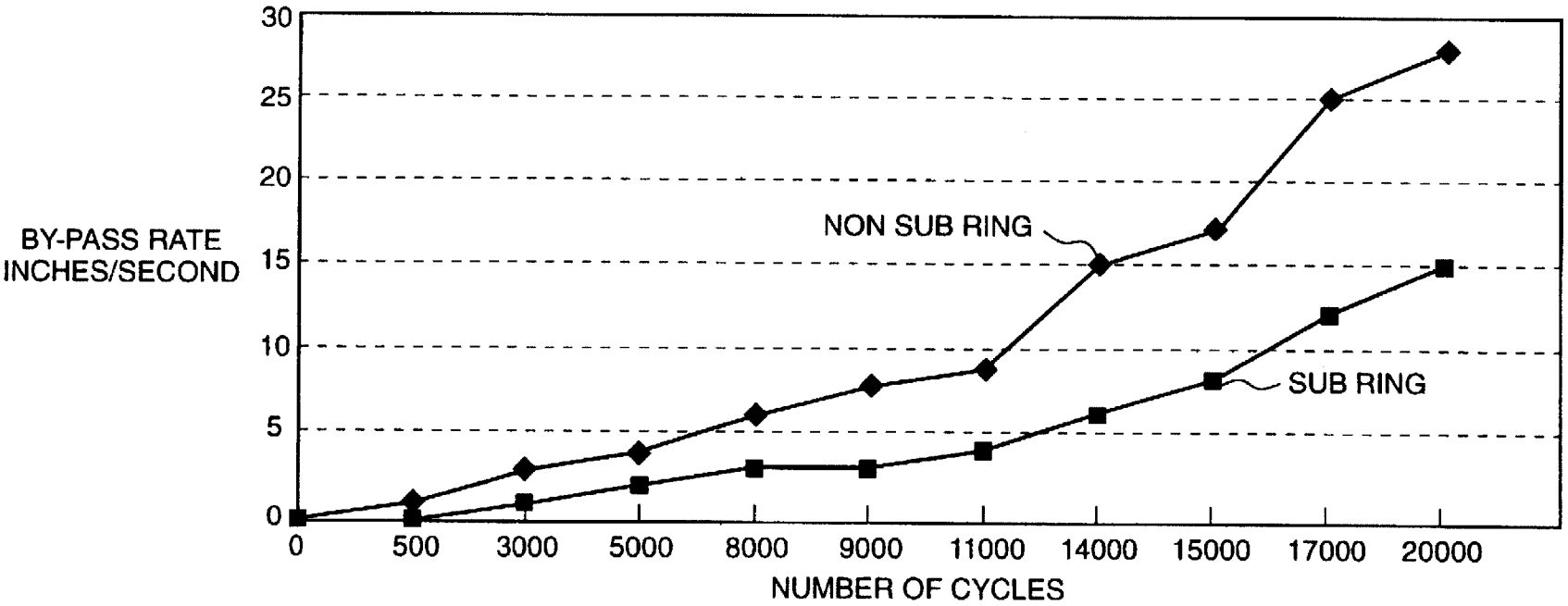
FIG. 8 is a graphic comparison of the by-pass rates of an apparatus for injection molding of a metallic material with and without a sub-ring as a function of the number of cycles of apparatus operation.

A comparison of the respective by-pass rates as a function of the number of cycles that each apparatus was operated is shown in FIG. 8. The apparatus without the sub-ring reached a by-pass rate of 15 inches per second at 14,000 cycles, while the apparatus equipped with the sub-ring did not reach a by-pass rate of 15 inches per second until 20,000 cycles. Thus, the use of the sub-ring resulted in a 42.8% increase in the useful life of the non-return valve.

The ability of the non-return valve to maintain a good seal directly impacts the ability of the part being produced to be filled completely with little or no knit lines or voids. The pressure maintained after the die cavity fills before solidification of the material is vitally important to the process of producing a sound cast component. If this pressure is reduced because of high rates of leakage (by-pass), the soundness of the part is reduced and the potential for knit lines is increased.

It follows that the reduction of by-pass seen when using the sub-ring concept of the present invention means that good quality parts will be produced for a longer time before the system needs to be replaced.

While the invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the appended claims.

Thus, it is to be understood that variations in the present invention can be made without departing from the novel aspects of this invention as defined in the claims. All patents cited herein are hereby incorporated by reference in their entirety and relied upon.

What is claimed is:

1. In an apparatus for injection molding a metallic material having dendritic properties, said apparatus comprising:

(a) an extruder barrel having a discharge nozzle at one end, a material accumulation zone adjacent said nozzle, and an inlet remote from said nozzle;

(b) feeding means for introducing said material into said barrel via said inlet;

(c) means for heating said material in said barrel to a temperature which is sufficiently high to inhibit dendritic growth;

(d) means for moving said material through said barrel from said inlet into said accumulation zone, wherein said means for moving said material through said barrel comprises an extruder screw having a non-return valve assembly and wherein said non-return valve assembly comprises a sliding seal ring and one or more piston rings, said piston rings situated between said sliding seal ring and said extruder barrel;

(e) means for expanding said accumulation zone independently of the movement of said material into said accumulation zone and at a rate at least as great as that at which said material is moved into said accumulation zone, thereby avoiding the imposition of appreciable force on said material in said accumulation zone;

(f) means for shearing said material as it moves through said barrel between said inlet and said accumulation zone; and (g) means for discharging said material from said accumulation zone through said nozzle into a mold;

the improvement comprising said non-return valve assembly having a sub-ring, said sub-ring situated between one or more piston rings and said sliding seal ring.

2. The apparatus of claim 1, wherein said barrel has a plurality of longitudinally spaced heating zones, each of which is heated by said heating means to establish for said material a temperature profile which increases in a direction toward said nozzle.

3. The apparatus of claim 1, wherein said feeding means includes means for introducing said material into said barrel at a rate less than 100 percent of its capacity.

4. The apparatus of claim 1, wherein said means for expanding said accumulation zone comprises means for moving said screw in a direction away from said nozzle.

5. The apparatus of claim 1, wherein said heating means maintains said temperature of said material in said accumulation zone at a level higher than elsewhere.

6. The apparatus of claim 1, wherein said material introduced via said feeder into said barrel is in pellet form.

7. The apparatus of claim 1, wherein said material introduced into said barrel is at ambient temperature.

8. The apparatus of claim 1, wherein said heating means maintains the temperature of said material in said barrel between the liquidus and the solidus temperatures of said material.

* * * * *